US005539854A

United States Patent [19]

Jones et al.

[11] Patent Number: 5,539,854

[45] Date of Patent: Jul. 23, 1996

[54] HEAT CONTROLLED HUMIDIFIER FOR INFANT INCUBATOR

[75] Inventors: Thomas C. Jones, Columbia; Harry E. Belsinger Jr., Baltimore; Michael H. Mackin, Ellicott City, all of Md.

[73] Assignee: Ohmeda Inc., Liberty Corner, N.J.

[21] Appl. No.: 260,855

[22] Filed: Jun. 15, 1994

[51] Int. Cl.[6] ..... A61H 33/12; A61G 11/00

[52] U.S. Cl. ..... 392/403; 600/22

[58] Field of Search ..... 392/403–405; 219/385–386; 600/22; 123/549, 556

[56] References Cited

U.S. PATENT DOCUMENTS

| | | | |
|---|---|---|---|
| 3,782,362 | 1/1974 | Puzio | 600/22 |
| 4,565,176 | 1/1986 | Alf | 123/556 |
| 4,617,912 | 10/1986 | Beer | 600/22 |
| 4,687,132 | 8/1987 | Suzaki | 123/41.12 |
| 4,936,824 | 6/1990 | Koch | 600/22 |
| 5,071,066 | 12/1991 | Willson | 236/92 |
| 5,224,923 | 7/1993 | Moffett | 600/22 |

*Primary Examiner*—Teresa J. Walberg
*Assistant Examiner*—Sam Paik
*Attorney, Agent, or Firm*—Roger M. Rathbun; Larry R. Cassett; R. Hain Swope

[57] ABSTRACT

A heated humidifier for an infant incubator wherein the flow of air through the humidifier that picks up water vapor from the surface of the water is controlled in response to the temperature of the heater used to heat the water. In the preferred embodiment, the heater is an active heater located above the surface of the water and includes an extruded heat exchanger that depends downwardly from the heater to below the level of the water. A thermal actuator is located in good heat transfer association with the extruded heat exchanger at a point above the surface of the water and that thermal actuator controls the position of a valve in the outlet of the humidifier.

17 Claims, 4 Drawing Sheets

HEAT CONTROLLED HUMIDIFIER FOR INFANT INCUBATOR

BACKGROUND OF THE INVENTION

This invention relates to infant incubators and, more particularly, to a heated humidifier for humidifying the air delivered to the infant compartment within which the infant is positioned and which has a thermally actuated valve controlling the flow of humidified air from the humidifier.

It is advantageous to provide humidified air to the infant compartment of an incubator in caring for the infant and current incubators provide various methods for providing that humidification.

In such humidifiers, generally a flow of air is passed across the surface of water contained within a reservoir to pick up water vapor from the water to humidify the flow of air. That humidified air is thereafter caused to enter the infant compartment to reach the infant. In some humidifiers, no active heating means is employed to actually heat the water for vaporization. These humidifiers rely upon heat contained in the flow of air through the humidifier to vaporize the water.

In other humidifiers, however, an active heater is used to heat the water within the reservoir so that additional humidification is possible for providing the water vapor to the stream of air passing across the surface of the water. The present invention is specifically directed to the latter type of humidifier, that is, a humidifier having an active heater transferring heat to the water.

A difficulty in humidifiers for incubators, however, is in controlling the addition of water vapor to the stream of air that is intended for the infant. It is important that the humidifier be isolated from the flow of air to the infant at times when humidification is not desired and therefore, it is advantageous to provide some means to valve or control the flow of humidified air from the humidifier at times when no humidity is desired as well as to provide some control at other times.

In some humidifiers today, however, the active air stream may be diverted or physically cut off from passing across the surface of the water, however the water may otherwise remain in the circuit and inadvertent air flow may continue to allow passively humidified air to emerge from the humidifier and enter the stream of air to the incubator compartment. In such cases, the operator may not want any humidity to reach the infant but is unaware of the inadvertent addition of humidity or can do nothing to prevent the passive creation of water vapor that finds its way into the infant compartment.

SUMMARY OF THE INVENTION

The present invention provides an improved heated humidifier for use with an infant incubator and which includes a thermally actuated valve that responds to temperature changes in the heater to control the flow of humidified air into the steam of air leading to the infant compartment.

In the present invention, a flow control valve is positioned within the humidifier and which controls the stream of air that flows through the humidifier and which picks up the water vapor. That valve is controlled by the temperature of the heater that is used to heat the water and opens to allow air to pass though the humidifier to be humidified when the heater is activated and closes when the temperature of the heater drops when the heater is inactivated.

In this way, when the heater is not on, the temperature of the heater is generally below that required to thermally actuate the valve at ambient temperature and the thermally actuated valve is closed, thus preventing air from inadvertently passing across the surface of the water where it could then enter the stream of air to be delivered to the infant compartment. When the heater is turned on by the operator or by some automatic means, the heater temperature rises and the thermally actuated valve responds to that rise in temperature to open, thus the path is open for air to move across the surface of the water to become humidified and to be eventually introduced into the infant compartment.

In the preferred embodiment, the heater comprises an electric heater that is positioned above the surface of the water in the reservoir of the humidifier and a heat exchanger extends downwardly from the electric heater to below the surface of the water to heat the water. A thermal actuator is actually positioned within the heat exchanger so that the response time is as short as possible and the thermally actuated valve therefore responds rapidly to open the flow through the humidifier.

Similarly, the thermal actuator is positioned above the surface of the water within the heat exchanger and has good response to the rise and fall of temperature of the heater and yet is isolated from the water itself.

Other features of the heat controlled humidifier will become apparent in light of the following detailed description of a preferred embodiment thereof and as illustrated in the accompanying drawings.

DESCRIPTION OF THE PREFERRED EMBODIMENT

Figure 1:
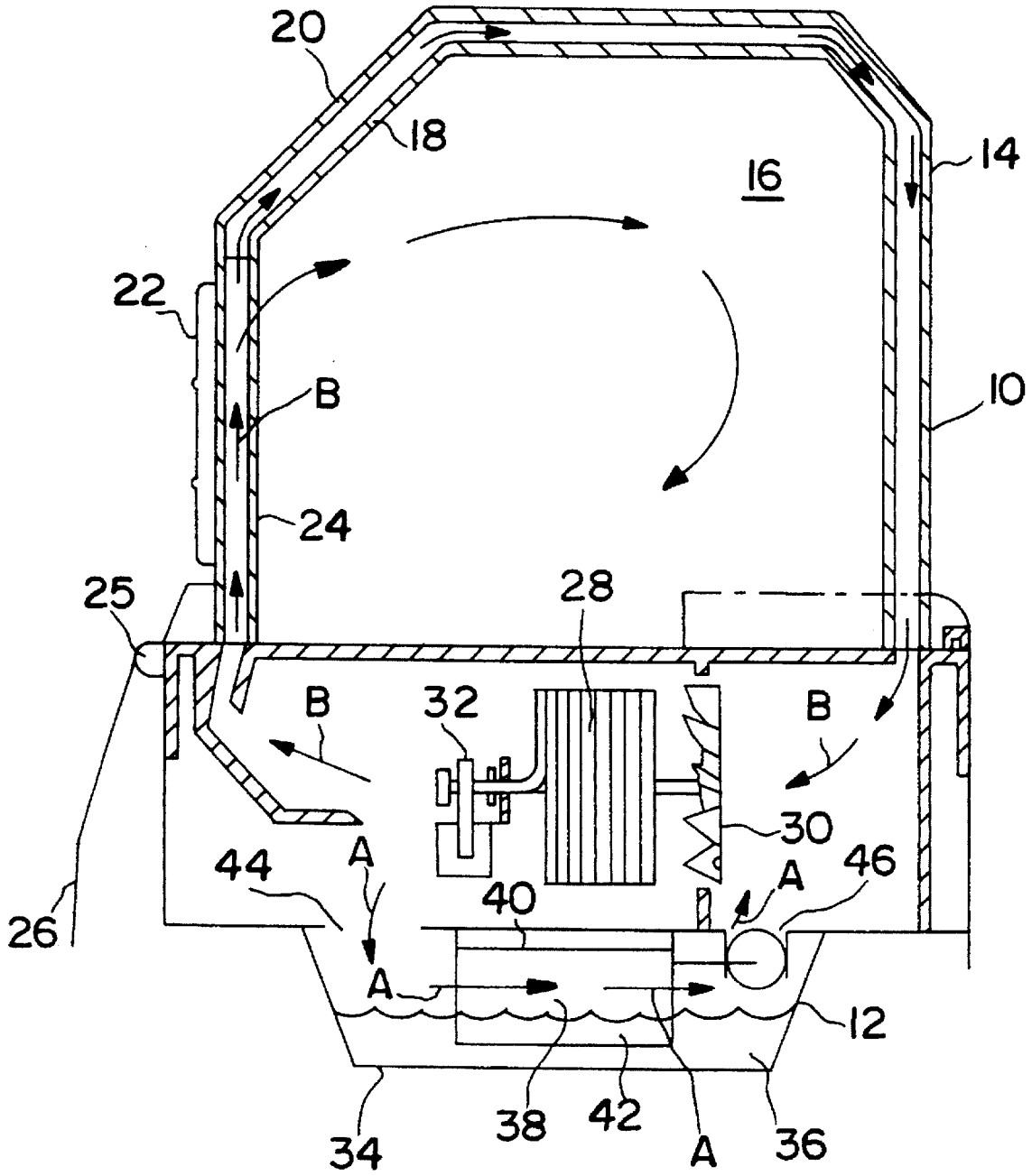
FIG. 1 is a side schematic view showing the heat controlled humidifier of the present invention in position on an infant incubator.

Referring now to FIG. 1, there is shown a schematic of an infant incubator 10 and which includes the heat controlled humidifier 12 constructed in accordance with the present invention. The incubator 10 is basically of the design shown and described in U.S. Pat. No. 4,936,824, issued Jun. 26, 1990 and therefore will only be briefly described herein. In particular, the incubator 10 includes a hood 14 that surrounds and enclosed therein an infant compartment 16 within which the infant is located. In the preferred embodiment, hood 14 is of a double wall construction in which an inner wall 18 and an outer wall 20 form a passageway through which heated air circulates in the directions of the arrows B. The hood 14 is generally constructed of a transparent plastic material so that the infant is readily viewed at all times by the attending personnel.

The hood 14 may also include portholes 22 for the attending personnel to gain access to the infant or to carry out various procedures on the infant. An access door 24 is pivoted outwardly on hinges 25 for placing the infant within the infant incubator 10 or for removal therefrom.

Infant incubator 10 also includes a base 26 within which is located the means to heat and circulate the air through the hood 14 and which includes a conventional heater 28 and a fan 30 that induces the flow of air from the rear of the hood 14 past the heater 28 so that the circulated air is thus heated and then reintroduced into the hood 14 at the front of the incubator 10. The fan 30 is, of course powered by an electric motor 32 and which is controlled in accordance with the disclosure of the aforementioned U.S. Pat. No. 4,936,824.

As can be seen in FIG. 1, the heat controlled humidifier 12 depends downwardly from the infant incubator 10 and includes a reservoir 34 that, in use, contains a quantity of water 36. The reservoir 34 is constructed of a transparent plastic material that allows the attending personnel to visually ascertain the level of the water 36. Since the quantity of the water 36 needs to be at least a certain amount, the personnel can visually ascertain when the level is low and add additional water when it is needed.

The water 36 is actively heated by a heater means 38 and, in the preferred embodiment, includes an electric heater 40 that may be a strip heater affixed to the top of a heat exchanger 42 that extends downwardly into and below the surface of the water 36. By this means, the electric heater an active heater and is 40 is positioned safely above the surface of the water and the heat exchanger 42, which may be an aluminum extrusion of a particular shape, extends into the water to heat that water. The preferred shape and position of the heat exchanger 42 will be later explained.

The electric heater 40 is controlled by conventional controls, not shown, to allow the operator to activate the heating means 38 when humidification is desired to be added to the stream of air to the infant compartment 16 and to turn off the heater when no humidification is desired.

As indicated, the main flow pattern through the infant incubator 10 to enter the infant compartment 16 is shown by the arrows B. A separate sidestream is created for use of the heat controlled humidifier 12 and that flow is generally in accordance with the arrows A. The flow of air for the heat controlled humidifier 12 thus enters the heat controlled humidifier 12 through the inlet opening 44 which withdraws a portion of the main stream of air moving through the infant incubator 10. That flow through the inlet opening 44 is created by the path of least resistance, that is, there is a certain resistance in the flow of air along the arrows B and in entering the double wall hood 14 at the front of the infant incubator 10. Some of the air, therefore naturally seeks an alternative flow path and which is provided by the path through the heat controlled humidifier 12.

Accordingly, that sidestream of air passes through heat controlled humidifier 12 along the surface of the water 36 and picks up the water vapor at the surface of the water as previously described. The heat exchanger 42 provides the heat to the water to create water vapor and, as has been explained, the heat exchanger 42 is heated by an electric heater 40 located above the surface of the water 36.

The thus humidified air then reenters the main stream of air by reentering the base 26 through the outlet opening 46 located upstream of the fan 30 and thereby provides a source of humidified air to the main stream of air in the flow stream depicted by the arrows B. As is noted, although the main flow of air is contained within the double walled hood 14, some of that air enters the infant compartment 16 and therefore reaches the infant.

As can be seen, therefore, the heat controlled humidifier 12 is used in a continuous bypass stream of air that humidifies the air to the infant and which adds that humidified stream to the main flow of air to the infant for humidifying the infant compartment 16.

Finally, with respect to FIG. 1, a valve 48 is shown positioned within the outlet opening 46 and which is operated by a thermal actuator as will be explained.

The function of the valve 48 is to open and close the outlet opening 46 to control the flow of humidified air from the heat controlled humidifier into the base 26 of the infant incubator. Thus, when the valve 48 is closed, the outlet opening 46 is substantially sealed such that no humidified air may leave the heat controlled humidifier 12 to enter the main stream of air that eventually reaches the infant compartment 16. Obviously, when valve 48 is opened, the humidified air does pass through outlet opening 46 and the humidified air is introduced into the infant compartment 16. Various other positions of the valve 48 provide intermediate control to the flow of such humidified air.

Figure 2:
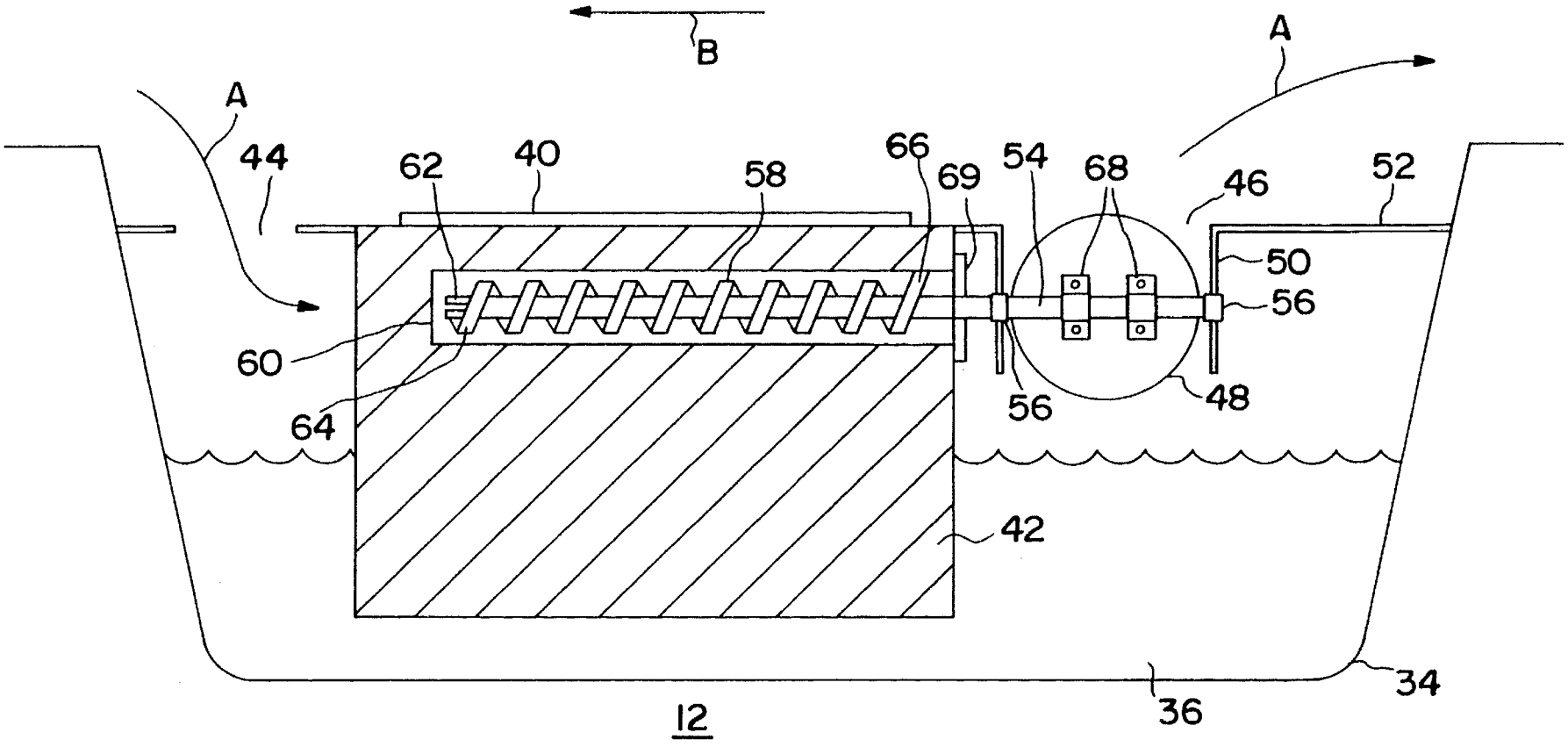
FIG. 2 is a side schematic view showing an embodiment of the heat controlled humidifier constructed in accordance with the present invention.

Turning now to FIG. 2, there is shown a schematic view of a heat controlled humidifier 12 constructed in accordance with the present invention. In FIG. 2, the thermal actuator can be explained with respect to its control of the humidified air that is produced in the heat controlled humidifier 12. The valve 48 is enclosed within a shroud 50 that depends downwardly from the cover 52 of heat controlled humidifier 12. Valve 48 is positioned on a shaft 54 that is supported for rotational movement by bearings 56 and thus the valve 48 rotates within shroud 50 to open or close the outlet opening 46.

The actual rotation of the valve 48, and thus its position within shroud 50 is controlled by the thermal actuator which, in the FIG. 2 embodiment, is a bimetallic spiral strip 58 and which is positioned within a bore 60 in heat exchanger 42. As defined herein the forward direction is that toward the valve 48 while the rearward direction shall be toward the closed end of the bore 60. Thus, the rearward end 62 of the shaft 54 is affixed to the rearward end 64 of the bimetallic spiral strip 58 while the forward end 66 of the bimetallic spiral strip 56 is affixed to the interior forward end 68 of the bore 60. Obviously, the forward end 66 of bimetallic spiral strip may be affixed at other positions within the bore 60, it being understood that the forward end 66 is affixed somewhere and thus is not movable in this embodiment.

As can be seen, therefore, as the bimetallic spiral strip 58 is heated whenever the heat exchanger 42, likewise, is heated by energizing the electric heater 40, the bimetallic spiral strip 58 will rotate and cause the valve 48 to also rotate. In the construction of this embodiment, therefore, when the unit is at normal ambient temperature, the valve 48 can be manually rotated to the closed position with respect to the outlet opening 48 and then affixed firmly in that position by tightening fasteners 68 that hold the valve 48 to shaft 54. Then, as the bimetallic spiral strip 58 is thereafter heated, the shaft 54 is caused to rotate by the bimetallic spiral strip 58 to open the valve 48 to the intended position. A seal 69 may also be provided to protect the internal area of the bore 60 from the external moist environment.

Briefly, therefore, when the operator desires to add humidity to the infant compartment (FIG. 1) the electric heater 40 is energized and which in turn heats the heat exchanger 42 to heat the water 36 for creating water vapor at the surface of the water 36. As the heat exchanger 42 is heated, its temperature rises and heats the bimetallic spiral strip 58 causing it to rotate the shaft 54, thereby also rotating the valve 48. The valve 48 therefore opens to allow the interior of the heat controlled humidifier 12 to communicate with the main stream of air that progresses toward and into the infant compartment 16.

As the valve 48 opens, the air can flow into the heat controlled humidifier 12 via inlet opening 44 across the surface of the heated water 36 where it is humidified and then pass though the outlet opening 46 into that main stream of air depicted by the arrows B.

When the operator desires to discontinue the humidity to the infant compartment 16, the electric heater 40 is deenergized and thus its temperature drops. In the opposite fashion as previously described, the bimetallic spiral strip 58 is also cooled and the rotational motion of the bimetallic spiral strip thereupon closes the valve 48 and shuts off the outlet opening 46 to prevent further humidified air from the heat controlled humidifier 12 from entering the flow of air to the infant compartment 16. Thus, when outlet opening 46 is closed, air cannot inadvertently pass through the heat controlled humidifier 12 to add any additional humidity to the infant compartment and the operator is assured that the humidification of the infant compartment 16 has been completely terminated.

Figure 3:
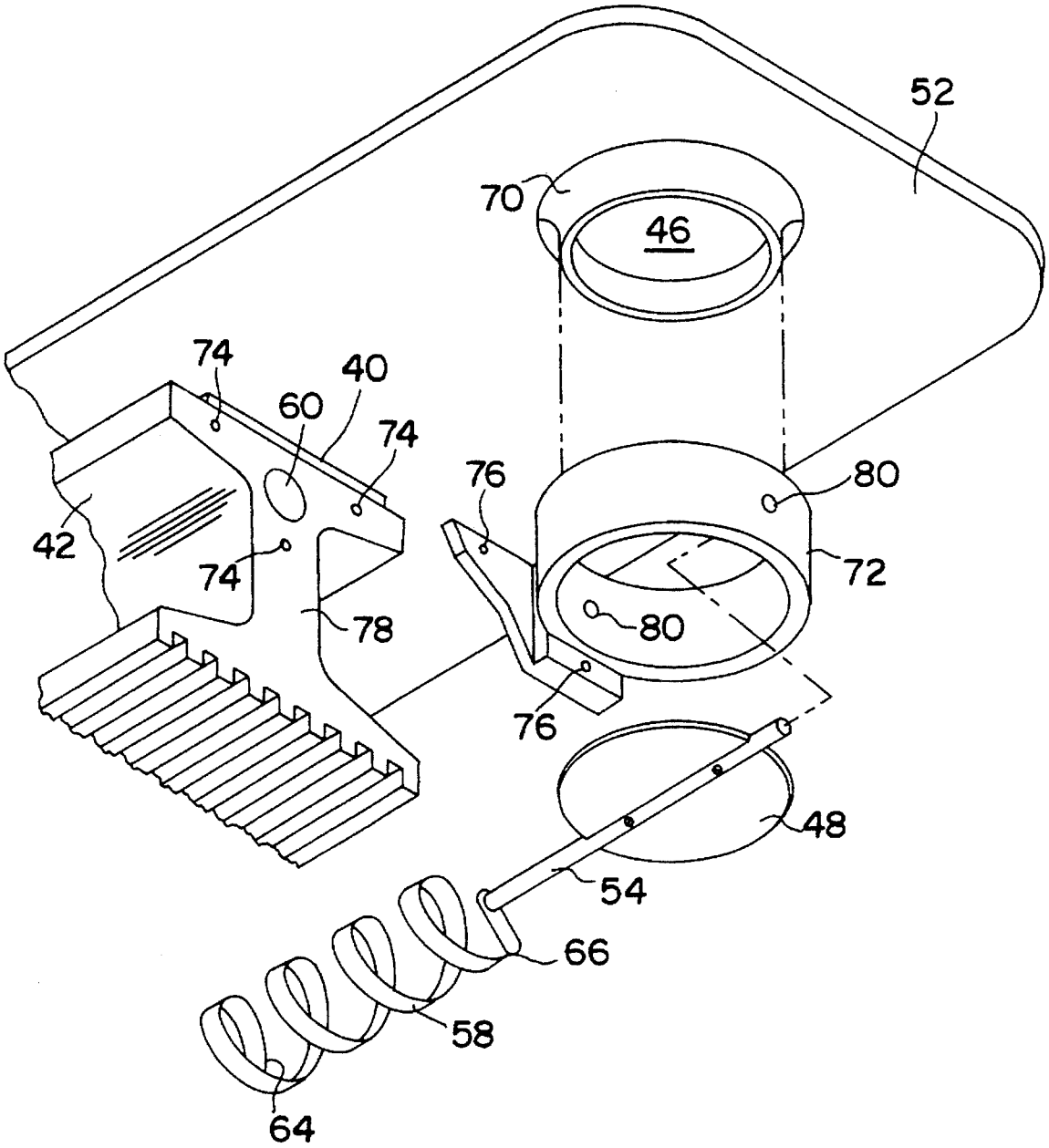
FIG. 3 is an exploded, schematic view of the details of the FIG. 2 embodiment.

Turning now to FIG. 3, there is shown a schematic, exploded view of a slightly different version of the embodiment shown in FIG. 2. In this embodiment, a downwardly curved lip 70 is formed in the cover 52 of the heat controlled humidifier 12 and which interfits into the cylindrical throat 72 to seal thereagainst. When assembled, the cylindrical throat 72 is affixed to the heat exchanger 42, by conventional mechanical means such as screws and for that purpose, the forward face of the heat exchanger 42 includes holes 74 that align with corresponding holes 76 in the cylindrical throat 72 to secure the parts together.

As may be seen in this embodiment, the heat exchanger 42 is affixed to the cover 52 by an adhesive or by mechanical means of conventional type and the electric heater 40 may be positioned between the heat exchanger 42 and the cover 52. The heat exchanger 42 is shaped as a I-beam with a relatively large area above the level of the water 36 affixed to the cover 52. Heat exchanger 42 has a corresponding large area at the downward extremity, and when, in use, remains beneath the surface of the water 36. The intermediate area, is a narrowed section 78 so that the heat is to the large extent, transferred to the water 36 and not dissipated in the path of the air flowing above the surface of the water 36.

Accordingly, it is preferred to locate the thermal actuating means to operate valve 48 at the top of the narrowed section 78 to enhance the response time of the thermal actuating means. Bore 60 is shown in the preferred location and contained within that bore is the bimetallic spiral strip 58. In this FIG. 3, the thermal actuating means is slightly different than that shown schematically in FIG. 2, however both embodiments function in the same manner. In FIG. 3, the forward end of the bimetallic spiral strip 58 is affixed to the shaft 54 and which rotates within the cylindrical throat 72 supported by shaft 54 fitting through a pair of openings 80 in the cylindrical throat 72.

The rearward end 64 of the bimetallic spiral strip 58 is therefore affixed to the inside of the rearward end of the bore 60 such that the rearward end 64 of the bimetallic spiral strip 58 is stationary and the forward end 66 rotates to open and close the valve 48 within cylindrical throat 72.

Figure 4:
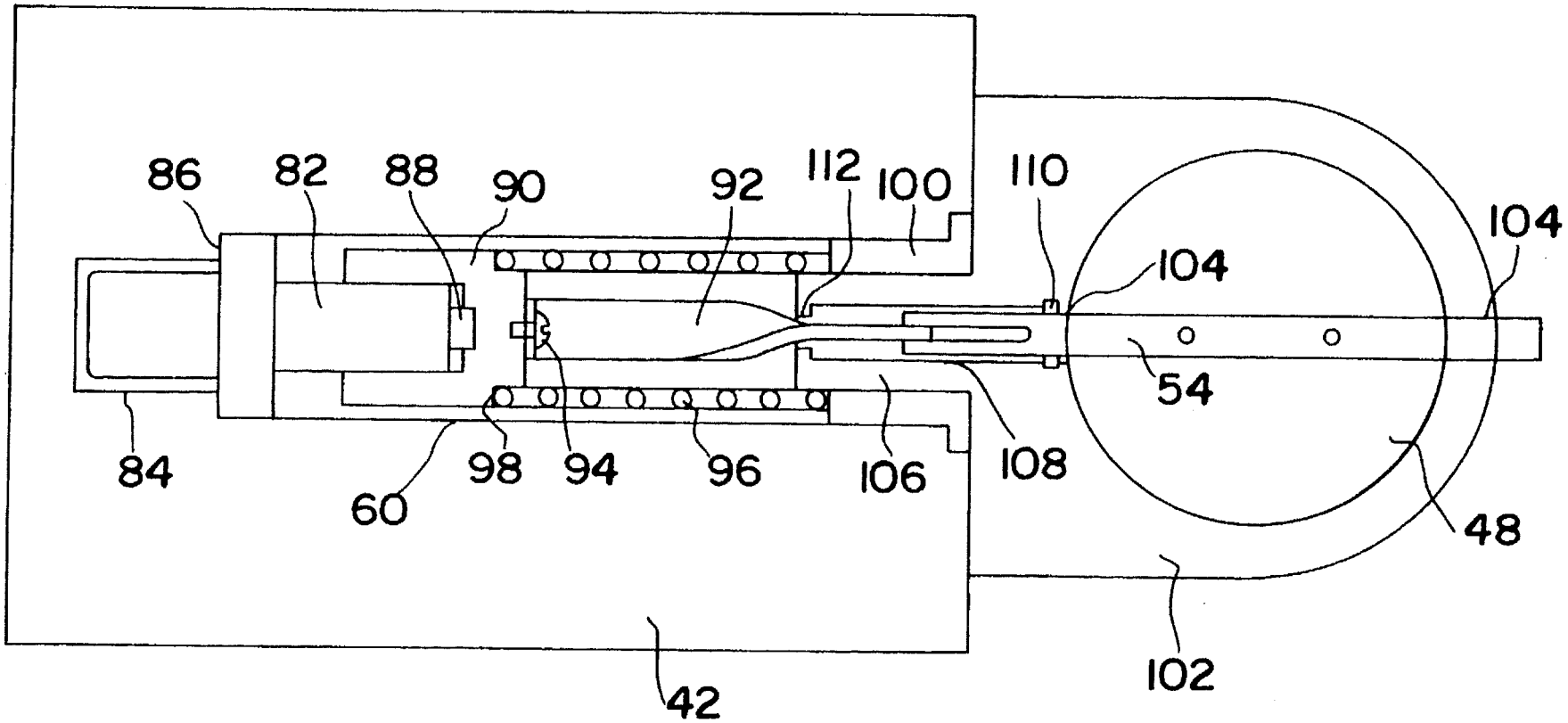
FIG. 4 is a top schematic view of the preferred embodiment of the heat controlled humidifier of the present invention.

Turning lastly to FIG. 4, there is shown a top schematic view of the preferred embodiment of the heat controlled humidifier 12 constructed in accordance with the present invention. In this embodiment, the thermal actuator is a wax motor 82 and which is a commercially available device that produces axial movement of a piston in accordance with increasing temperatures. Such devices are available from the Caltherm Company of Bingham Falls, Mich. and one selectable wax motor usable in the present application is available where the piston commences to move at about 110 F and is fully extended at about 130 F. The stroke of the piston is about 0.2 inches.

In FIG. 4, the wax motor 82 is positioned within the bore 60 of heat exchanger 42 in a similar manner as is the FIGS. 2 & 3 embodiments. In this case, however, an extended narrow bore 84 is formed further rearward into the heat exchanger 42 and seats the wax motor 82 in a predetermined position against a ledge 86 thereby formed. The piston 88 of the wax motor 82 thereby moves axially outwardly from the wax motor 82 as the temperature increases and acts against a guide 90 movable within bore 60.

A strip 92 is affixed to the forward end of the guide 90 and is affixed in a manner such that it can freely rotate or swivel with respect to the guide 90. As shown, one means of attaching the strip 92 is by a screw 94. It is important to note, however, that even with its affixation to the guide 90, the strip 92 is free to rotate with respect to that guide 90.

A spring 96 acts against a forward annular rim 98 formed on the guide 90 with the other end of the spring 96 retained in position by an insert 100 that is threaded into the forward end of the bore 60. Thus the spring 96 is compressed as the piston 88 moves outwardly from wax motor 82 and the spring 96 acts against that movement and returns the piston 88 back into the wax motor 82 when the temperature is lowered since the wax motor 82 operates to move the piston 88 outwardly with an increase in temperature but does not have the ability to again withdraw that piston 88 back into the wax motor 82 when the temperature is again reduced to its lower level.

In the FIG. 4 embodiment, a valve housing 102 enclosed the valve 48 and which is supported for rotational movement therein by openings 104 in the valve housing 102 as in the prior embodiments. A cylindrical flange 106 extends outwardly from the valve housing and fits within the bore 60. Within cylindrical flange 106 is a cylindrical bore 108 having at its forward end, a seal such as an O-ring 110 that seals against the shaft 54 and at the rearward end of the cylindrical bore 108, there is a slot 112. The purpose of the slot 112 will become apparent. The forward end of the strip 92 is slotted and interfits with the rearward end of the shaft 54 such that the coupling allows axial movement between those components but rotational movement is readily transmitted from the strip 92 to the shaft 54.

It is obviously necessary in the operation of the valve 48 to translate the axial movement of the piston 88 into rotational movement to rotate the valve 48 and that translation is accomplished by bending the strip 92 to a predetermined angle, preferably 90 degrees. The bend is positioned such that, at ambient temperatures, the strip 92 goes through the slot 112 and is coupled with the shaft 54 such that the valve is in its closed position. As the temperature of the wax motor 82 increases as previously explained with respect to the prior embodiments, the strip 82 is moved axially toward the valve 48 and the twisted portion of the strip 92 moves through the fixed slot 112, thereby causing the strip 92 to rotate. That rotation is translated to the shaft 54 and which also rotates to open the valve 48.

Thus as in the prior embodiments, the opening of the valve 48 is in response to an increase of temperature of the heating means, in particular, the heat exchanger 42. Again, when the operator deenergizes the electric heater (not shown in FIG. 4) the spring 96 forces the piston 88 of the wax motor 82 back into the wax motor 82 and the valve 48 closes.

As can be seen therefore, the thermal actuator controls the movement of the valve 48 to open or close the same dependent upon the temperature of the heating means, that is the electric heater 40, the heat exchanger 42 or the thermal actuator could be located in various positions within the heat controlled humidifier 12 as long as it responds to the heat that is used to heat the water to cause a temperature rise sufficient to actuate the thermal actuator. In addition, that thermal actuator then causes the valve 48 to open and close in accordance with an increase or decrease of temperature resulting from the heating means for the water. Obviously various types of valves may be employed and various mechanisms may be used to actually operate the valve, such as a stepper motor that is controlled by the temperature of the heating means for the water.

It will be understood that the scope of the invention is not limited to the particular steps or materials disclosed herein, by way of example, but only by the scope of the appended claims.

We claim:

1. A humidifier for use with an infant incubator having an infant compartment for containing an infant and having a heated air flow stream for introduction to the infant compartment, said humidifier comprising an inlet for receiving air from the flow stream of the incubator and an outlet for returning humidified air to the flow stream of the incubator, a reservoir for containing a quantity of liquid, heater means within said reservoir for heating the quantity of liquid within said reservoir, said reservoir having a flow path communicating between said inlet and said outlet for air to pass through said humidifier over the surface of the liquid to receive vapor therefrom to humidify the air, a valve within said humidifier and located in the flow path through said humidifier to control the flow of air therethrough and a thermal actuator responsive to the temperature of said heater to control the position of said valve to control the humidity in the flow stream of humidified air from said outlet for introduction to the infant compartment.

2. A humidifier as defined in claim 1 wherein said valve is located within said outlet of said humidifier.

3. A humidifier as defined in claim 1 wherein said thermal actuator is a bimetallic spiral strip that provides rotational movement in response to temperature changes brought about by said heater means.

4. A humidifier as defined in claim 1 wherein said thermal actuator is a wax motor providing axial movement in response to temperature changes brought about by said heater means.

5. A humidifier as defined in claim 4 wherein said humidifier further includes a means to translate the axial movement of said wax motor to rotational movement to control said valve.

6. A humidifier as defined in claim 1 wherein said heater means comprises an active heater above the surface of the water and a heat exchanger extending downwardly from said active heater to below the surface of the water.

7. A humidifier as defined in claim 6 wherein said heat exchanger has a bore located above the surface of the water and said thermal actuator is located within said bore.

8. A humidifier as defined in claim 7 wherein said heat exchanger is shaped as an I-beam and said bore is located in said narrowed section of said heat exchanger.

9. A humidifier as defined in claim 8 wherein said reservoir is a unitary plastic molded part.

10. An infant incubator for containing an infant, said incubator comprising:

a base section having a support underlying and supporting the infant;

a hood mounted upon said base section and forming an infant compartment therein for containing the infant;

air heating and ducting means in said base section heating air and delivering such heated air to the infant compartment;

a heated humidifier for humidifying at least a portion of the air delivered to said infant compartment, said humidifier having a reservoir containing a quantity of water;

said humidifier having an inlet for receiving air from said heating and ducting means and an outlet for discharging humidified air to enter said infant compartment, and having a passageway within said heated humidifier for directing the air along the surface of the water;

heater means within said heated humidifier for heating the water, and a valve within said heated humidifier and located in the passageway through said humidifier to control the flow of air therethrough and a thermal actuator responsive to the temperature of said heater means to control the position of said valve to control the humidity of the humidified air discharged from said outlet to enter said infant compartment.

11. An infant incubator as defined in claim 10 wherein said valve is located within said outlet of said heated humidifier.

12. An infant incubator as defined in claim 10 wherein said thermal actuator is a bimetallic strip that provides rotational movement in response to temperature changes of said heater means.

13. An infant incubator as defined in claim 10 wherein said thermal actuator is a wax motor providing axial motion in response to temperature changes of said heater means.

14. An infant incubator as defined in claim 13 wherein said heated humidifier of said incubator further comprises a means to translate the axial movement of said wax moor to rotational movement to control said valve.

15. An infant incubator as defined in claim 10 wherein said heater means comprises a heater located above the surface of the water and an extruded heat exchanger extending downwardly from said heater to beneath the surface of the water, said extruded heat exchanger having a bore therein located above the surface of the water and wherein said thermal actuator is located within said bore.

16. A method of controlling the flow of air through a heated humidifier containing a reservoir of water for providing humidified air to an infant incubator, said method comprising:

(a) introducing air through an inlet into the humidifier and removing humidified air from an outlet in the humidifier, (b) directing the flow of air between the inlet and the outlet across the surface of the water, (c) providing a heater to raise the temperature of the water within the reservoir, (d) controlling the flow of air through the humidifier in response to the temperature of the heater.

17. A method as defined in claim 16 wherein said step of controlling the flow of air through the humidifier includes locating a valve in the inlet of the humidifier and locating a thermal actuating means in heat transfer relationship to the heater to control the position of the valve.

* * * * *